US008405310B2

(12) United States Patent
Chiang

(10) Patent No.: US 8,405,310 B2
(45) Date of Patent: Mar. 26, 2013

(54) LED LAMP AND PRODUCTION METHOD OF THE SAME

(75) Inventor: Kun-Yuan Chiang, Taipei (TW)

(73) Assignee: Liquidleds Lighting Corp., Grand Cayman (KY)

( * ) Notice: Subject to any disclaimer, the term of this patent is extended or adjusted under 35 U.S.C. 154(b) by 0 days.

(21) Appl. No.: 13/458,268

(22) Filed: Apr. 27, 2012

(65) Prior Publication Data

US 2012/0212137 A1 Aug. 23, 2012

Related U.S. Application Data

(62) Division of application No. 12/394,079, filed on Feb. 27, 2009.

(30) Foreign Application Priority Data

Mar. 21, 2008 (TW) ..... 97110141 A

(51) Int. Cl.
*H01J 7/28* (2006.01)

(52) U.S. Cl. ..... 313/512; 315/112; 362/800; 362/295

(58) Field of Classification Search ..... None
See application file for complete search history.

(56) References Cited

U.S. PATENT DOCUMENTS

| | | | | |
|---|---|---|---|---|
| 2,780,746 | A * | 2/1957 | Arnott | 313/1 |
| 4,727,289 | A | 2/1988 | Uchida | |
| 5,749,646 | A | 5/1998 | Brittell | |
| 6,462,475 | B1 * | 10/2002 | Lee | 315/57 |
| 6,731,071 | B2 | 5/2004 | Baarman | |
| 6,786,625 | B2 * | 9/2004 | Wesson | 362/545 |
| 7,396,139 | B2 * | 7/2008 | Savage | 362/101 |
| 7,661,852 | B2 | 2/2010 | Yu | |
| 7,922,359 | B2 * | 4/2011 | Chiang | 362/294 |

* cited by examiner

*Primary Examiner* — Ashok Patel
(74) *Attorney, Agent, or Firm* — Finnegan, Henderson, Farabow, Garrett & Dunner, LLP

(57) ABSTRACT

An LED lamp including a glass lampshell and a stem assembly with one end inserted into the glass lampshell. The stem assembly comprises a glass trumpet tube with one end sealed within the glass lampshell to form a cavity within the glass lampshell and within the cavity a supporting component connected to the glass trumpet tube and supporting an LED emitter. The stem assembly further comprises a wire encompassed within the glass trumpet tube. The wire has one end extending outside of the cavity and the other end electrically connected to the LED emitter.

20 Claims, 9 Drawing Sheets

(Prior Art)

(Prior Art)

(Prior Art)

LED LAMP AND PRODUCTION METHOD OF THE SAME

This is a division of application Ser. No. 12/394,079, filed Feb. 27, 2009, which is based upon and claims priority under 35 USC 119 to Taiwan Patent Application No. 097110141, filed on Mar. 21, 2008, in the Taiwan Intellectual Property Office (TIPO), the entire contents of which are herein incorporated by reference.

FIELD

This invention in general relates to an LED lamp and a method for producing the same. More specifically, this invention relates to a glass-sealed LED lamp that can be produced by implementing a variation of the conventional incandescent lamp production processes and equipment. This invention also relates to a glass-sealed LED lamp that may have enhanced temperature control, heat dissipation, and output light flux features. Furthermore, there is provided a cost effective and environmentally friendly method for producing a glass-sealed LED lamp.

BACKGROUND

A conventional incandescent lamp filament is made of wolfram or tungsten. Such filament, to maintain its long life, must be energized in an environment that is isolated from oxygen, e.g., in a medium vacuum, for example, from 25 to $1\times10^{-3}$ torr or from 3 kPa to 100 mPa, or high vacuum, for example, from $1\times10^{-3}$ to $1\times10^{-9}$ torr or from 100 mPa to 100 nPa, or in an inert gas environment. Therefore, a conventional incandescent lamp must be sealed well and have a cavity that contains a medium vacuum, a high vacuum, or inert gas, so that the lifetime of the filament, which is within the cavity, can be assured.

In addition, because glass is friendly to the environment, durable, inexpensive, and able to be sealed well, it has been adopted to pack components that contain a medium vacuum, a high vacuum, liquid, or gas. For example, glass has been used in manufacturing incandescent lamps, fluorescent lamps, and vacuum tubes. Although glass has these advantages, the temperature generated by the heat-fusing process is high, and glass is vulnerable to cracking during such processes. Therefore, extensive research for developing successful equipment and processes for handling glass is necessary.

FIG. 1 shows a conventional method of producing an incandescent lamp. A lamp filament 12 and an exhaust pipe 20 are pre-fixed on a glass trumpet tube 16, and the above components are hitched together into a glass lampshell 10 that has its open end downward. Flame-heating nozzles 14 heat a neck 102 of the glass lampshell 10, and produce uprising heated airflows 13. In order to have uniform heating, the glass lampshell 10, exhaust pipe 20, and glass trumpet tube 16 are rotated together synchronously in the same direction, and then the neck 102 of the glass lampshell 10 is heated and fused together with the glass trumpet tube 16 as shown in FIG. 2.

FIG. 2 illustrates a conventional incandescent lamp. Both the fused glass trumpet tube 16 and the neck 102 of the glass lampshell 10 forms a cavity 11 that seals the lamp filament 12 inside, and remaining glass lampshell waste 104 falls off because of gravity as the glass lampshell 10 maintains its open end downward, i.e., having its open end facing toward a direction along the direction of the pull of gravity. In addition, the air can be evacuated from the exhaust pipe 20, or inert gas can be filled into the cavity 11 through the exhaust pipe 20. The exhaust pipe 20 is also made of glass, and therefore can be heated and enclosed to tightly seal the lamp filament 12 into the cavity 11. Furthermore, wire 18 is soldered to a lamp head (not shown in FIG. 2), and the lamp head is fixed on the glass lampshell 10.

A Light-Emitting Diode (LED) is a light-emitting device first proposed by U.S. Pat. No. 4,211,955 (Ray) for use as an emitter of a lamp. Ray's LED lamp has a standard lamp base and could directly replace the conventional incandescent lamp. However, since the LED emitter is inside a standard lampshell, or a transparent or half-transparent lampshell, there is poor heat dissipation or over-heat protection measures, and thus it easily leads to over-heat damage to the LED emitter at a working temperature.

U.S. Pat. No. 4,727,289 (Uchida) described improved protection measures and applied it to high-voltage LEDs, it was still not a good solution to solve the above-mentioned overheat problem.

FIG. 3 shows a conventional LED lamp. LED emitters 24 are first installed on a supporting component 26, which has a tail inserted into a plastic or rubber plug 28. The plastic or rubber plug 28, the LED emitters 24, and the supporting component 26 are then inserted into a glass lampshell 22, and the neck of the glass lampshell 22 is sealed. Furthermore, wire 30 is soldered to a lamp base 32, and the lamp base 32 is fixed on the glass lampshell 22.

The production of incandescent lamps has matured. There are already a number of automatic production processes and equipment that can be used to produce conventional incandescent lamps, and the production cost is relatively low. However, such methods have never been applied to the production of LED lamps, as using incandescent lamp production methods to produce LED lamps has some significant difficulties. For example, as mentioned above, while producing a conventional incandescent lamp, the open end of the glass lampshell 10 must remain downward, i.e., in the direction of the pull of gravity, so that the glass lampshell waste 104 can fall off automatically because of gravity, as shown in FIG. 2. However, during this heating process, the uprising heated airflows 13 (shown in FIG. 1) raise the air temperature inside the glass lampshell 10 to above 300° C., and this high temperature can last for more than 10 seconds. If this conventional method is applied to LED lamps, the high temperature will damage LED emitters, as the temperature that the LED chips can endure is lower than that of wolfram filaments. In addition, the regular material used to pack LED chips, such as plastics and resin, is also not high-temperature tolerable. For example, the temperature tolerance of regular LED chips is below 250° C., and, if exposed to an environment that is above 220° C. for more than 5 seconds, such LED chips will sustain damage. Therefore, the conventional incandescent lamp production method can not be used to pack LED lamps.

Embodiments consistent with the present invention overcome one or more problems with the above prior art.

SUMMARY

The present invention discloses an LED lamp including a glass lampshell and a stem assembly with one end inserted into the glass lampshell. The stem assembly comprises a glass trumpet tube with one end sealed within the glass lampshell to form a cavity within the glass lampshell and within the cavity a supporting component connected to the glass trumpet tube and supporting an LED emitter. The stem assembly further comprises a wire encompassed within the glass trumpet tube. The wire has one end extending outside of the cavity and the other end electrically connected to the LED emitter. A light-pervious liquid may further be filled, either partially or entirely, inside the cavity to enhance the heat-dissipation and increase the output light flux.

The present invention also discloses a method for producing an LED lamp. The method includes forming a stem assembly by using a glass trumpet tube to encompass an exhaust pipe and a wire, connecting a supporting component to the glass trumpet tube, and installing an LED emitter, which is electrically connected to the wire, on the supporting component. While maintaining the open end of a glass lampshell upward or in other words arranging the open end of the glass lampshell facing in a direction substantially opposite to the direction of the pull of gravity, the method includes inserting the end with the LED emitter of the stem assembly into the glass lampshell and heating the glass lampshell to have the glass trumpet tube sealed within the glass lampshell, thus forming a cavity within the glass lampshell. Following heating, one end of the exhaust pipe and one end of the wire remain outside of the cavity. A light-pervious liquid may further be filled into the cavity through the exhaust pipe and the said exhaust pipe may then be sealed.

DESCRIPTION OF THE EMBODIMENTS

Reference will now be made in detail to embodiments consistent with the present invention, examples of which are illustrated in the accompanying drawings.

In an embodiment consistent with the present invention, there is provided a glass-sealed LED lamp and a production method of the same. In particular, there is provided a glass-sealed LED lamp that could be produced by implementing a variation of the conventional incandescent lamp production process and equipment. There is also provided a glass-sealed LED lamp that has enhanced temperature control, heat dissipation, and output light flux features. Furthermore, there is provided a cost effective and friendly-to-environment method for producing a glass-sealed LED lamp.

Figure 1:
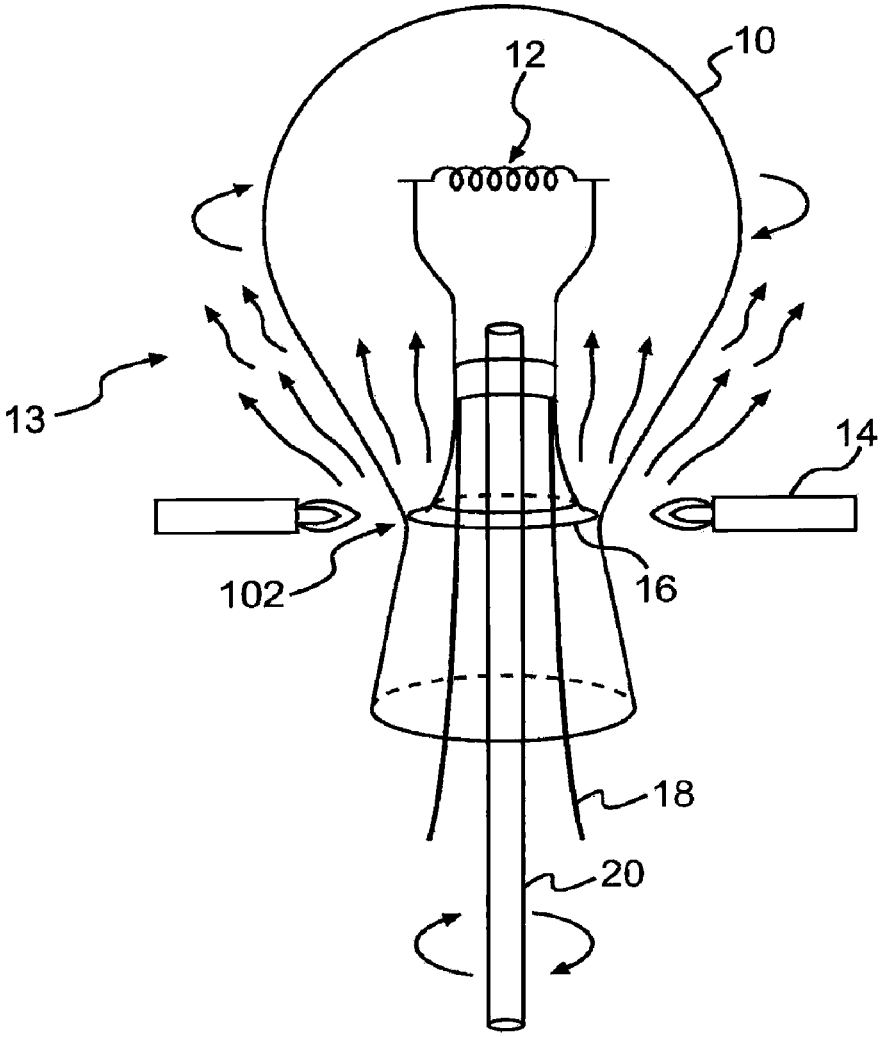
FIG. 1 illustrates the production of a conventional incandescent lamp.
Figure 2:
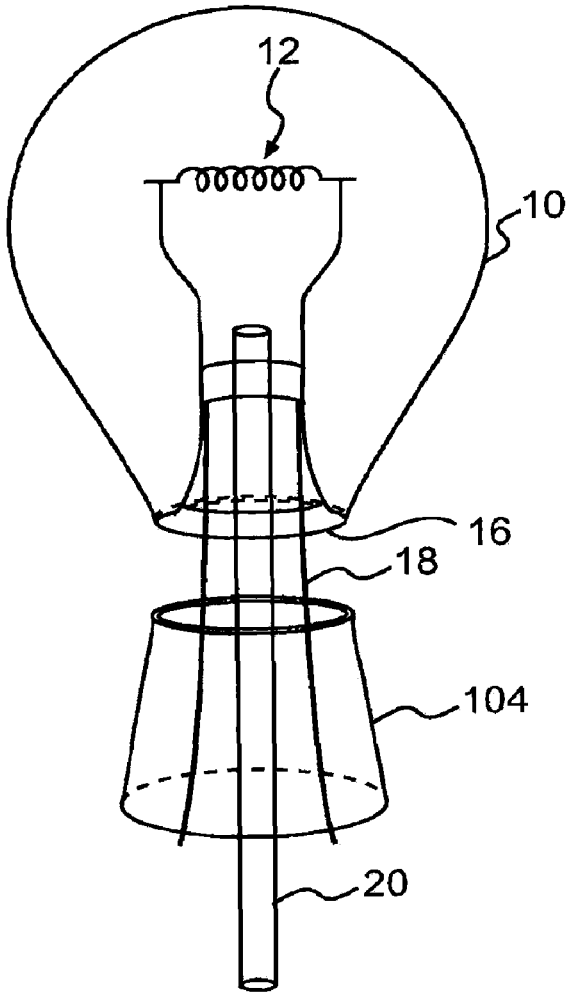
FIG. 2 illustrates a step for producing a conventional incandescent lamp.
Figure 3:
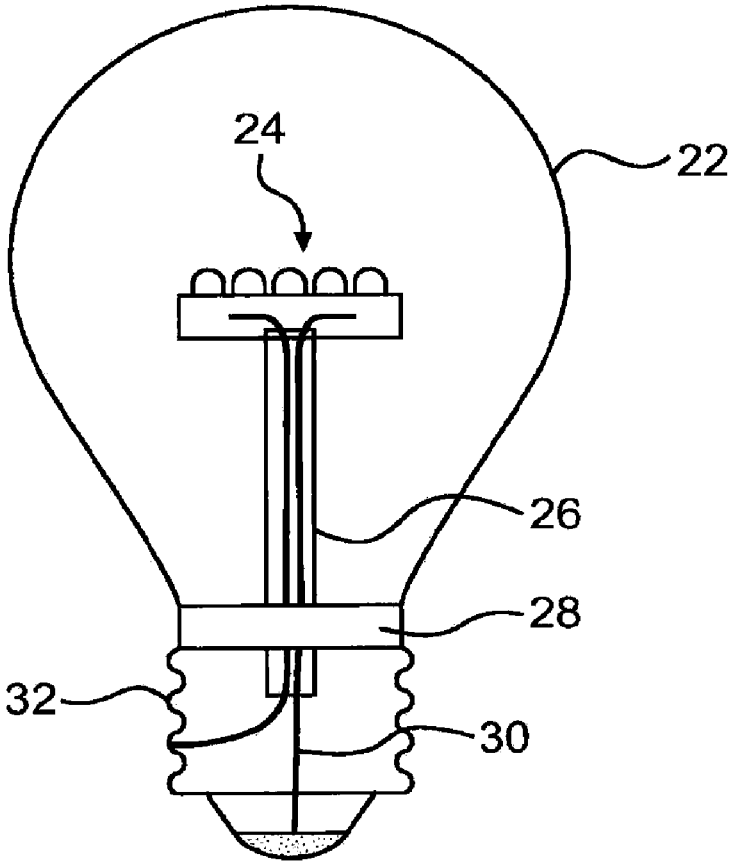
FIG. 3 illustrates a conventional LED lamp.
Figure 4:
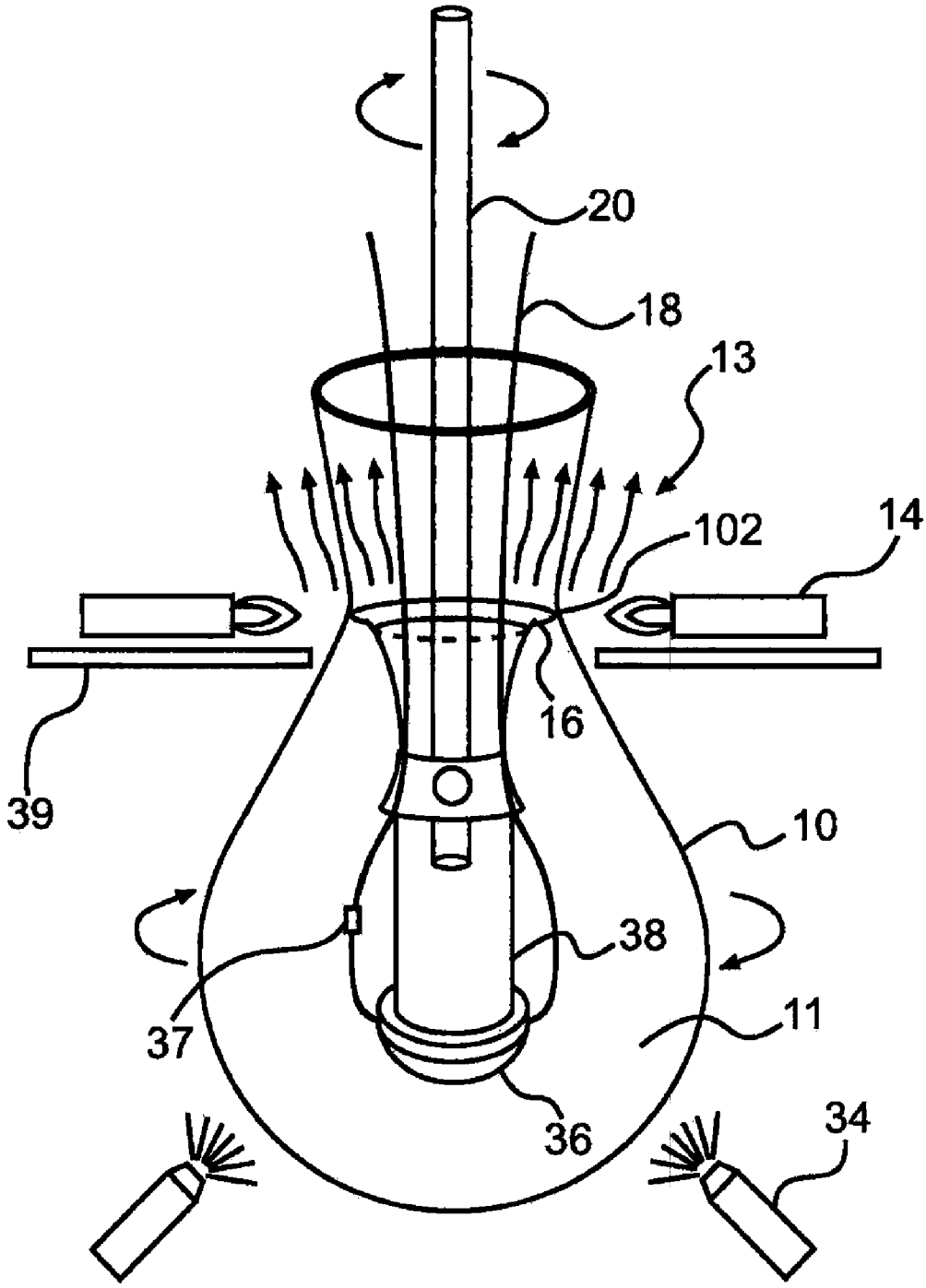
FIG. 4 illustrates a step of the production of an embodiment of an LED lamp consistent with the present invention.
Figure 5:
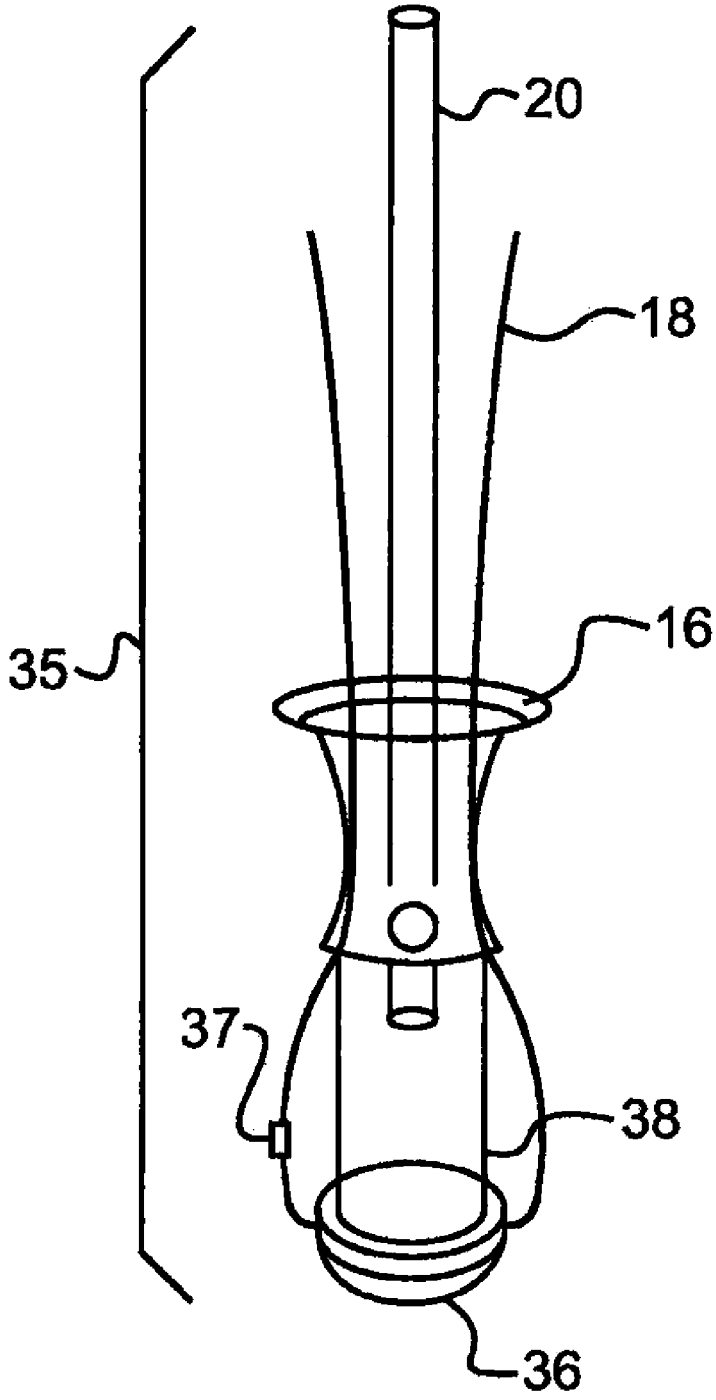
FIG. 5 illustrates the detailed structure of the stem assembly shown in FIG. 4.

FIG. 4 discloses an embodiment consistent with the principles of the present invention, and FIG. 5 discloses a stem assembly 35 shown in FIG. 4. The LED lamp consists of a stem assembly 35 and a glass lampshell 10. The stem assembly 35 comprises a glass trumpet tube 16 that has one end sealed within the glass lampshell 10 to form a cavity 11 within the glass lampshell 10, and within the cavity 11 a LED emitter 36 installed on a supporting component 38, which is connected to the glass trumpet lampshell 16. The glass trumpet tube 16 also encompasses an exhaust pipe 20 and a wire 18. The exhaust pipe 20 has one end extending outside of the cavity 11 and the other end within the cavity 11. The wire 18 has one end extending outside of the cavity 11 and the other end electrically connected in series with the LED emitter 36 and an optional temperature control component 37. The glass lampshell 10 has a neck 102 that may be fusion-connected by heating to one end of the glass trumpet tube 16 of the stem assembly 35. The cavity may contain a medium vacuum, for example, from 25 to $1\times10^{-3}$ torr or from 3 kPa to 100 mPa, or a high vacuum, for example, from $1\times10^{-3}$ to $1\times10^{-9}$ torr or from 100 mPa to 100 nPa. In addition, a light-pervious liquid (not shown in FIG. 4) may be filled at least partially inside the cavity 11 to enhance the heat-dissipation and increase the output light flux. It can be understood that in another embodiment, the liquid may be filled entirely inside the cavity 11.

Both the LED emitter 36 and the temperature control component 37 may be immersed in the light-pervious liquid, and the heat generated by the LED emitter 36 may be then dispersed to the light-pervious liquid. The temperature control component 37 may detect the temperature of the light-pervious liquid, and when the temperature exceeds a default value, the temperature control component 37 may either turn off the electricity or increase the current resistance, to cut off or reduce the current that runs through the LED emitter. The temperature control component 37 may prevent the operating LED emitter from continuing full-load operation under an over-heating condition. In addition, it may detect the temperature of the light-pervious liquid to prevent the glass lampshell 10 from explosive cracking caused by the expansion of the light-pervious liquid due to the raised temperature. The temperature control component 37 may comprise, for example, a thermo-resister of positive temperature coefficient, or a compound metal temperature switch. The default value of the temperature control component 37 maybe set to, for example, between 60° C. and 140° C. The light-pervious liquid may be chosen from liquids having, for example, a light refraction index of between 1.3 and 1.6 and a specific gravity of between 0.8 and 1.6 to enhance the output light flux and heat dissipation respectively.

The glass lampshell 10 may have, for example, an acid-etching exterior surface, a sandblasting exterior surface, or an exterior surface with light-scattering coating.

The glass lampshell 10 may have, for example, an acid-etching interior surface, a sandblasting interior surface, or an interior surface with light-scattering coating.

In addition, a light-scattering glue may be contained in the cavity 11.

For the method for producing an LED lamp, FIG. 4 also discloses an embodiment consistent with the principles of the present invention, and FIG. 5 discloses a stem assembly 35 shown in FIG. 4. The stem assembly 35 can be formed by using a glass trumpet tube 16 to encompass an exhaust pipe 20 and a wire 18, connecting a supporting component 38 to the glass trumpet tube 16, and installing an LED emitter 36, which is electrically connected to the wire 18 and to an optional temperature controller 37, on the supporting component 38. While remaining the open end of the glass lampshells 10 upwards or arranging said open end facing in a direction substantially opposite to the direction of the pull of gravity, insert the end with the LED emitter 36 of the stem assembly 35 into the glass lampshell 10, and then heat a neck 102 of the glass lampshell 10 by flame heating nozzles 14 to have the glass trumpet tube 16 sealed within the glass lampshell 10 and form a cavity 11 within the glass lampshell 10. After the heating, one end of the exhaust pipe 20 and one end of the wire 18 are remained outside of the cavity 11 that is formed by the heating.

During the heating process, the glass lampshell 10 and the stem assembly 35 may be rotated together synchronously in the same direction, and an air-blasting cooling device 34 blasts air onto the bottom of glass lampshell 10 to reduce the environment temperature of the LED emitter 36 and to control the air temperature inside the glass lampshell 10 to be, for example, under 180° C. Because the open end of glass lampshell 10 is upward or in the direction substantially opposite to the direction of the pull of gravity, the LED emitter 36 is located below the heat-fusion position, and the majority of uprising warm air can only go upward or upward towards the open end of the glass lampshell 10. Heat isolation plates 39 may be added under the flame heating nozzles 14, so that the LED emitter 36 may be somewhat isolated from the high temperature caused by the heating process. Therefore the possibility of damage to the LED emitter 36 due to overheating may be reduced. In addition, during this heating process, the air could also be evacuated from or be filled in via the exhaust pipe 20 to further reduce the air temperature inside the glass lampshell 10. It can also be understood that in another embodiment, the cavity 11 maybe filled with a gas other than air via the exhaust pipe 20.

Figure 6:
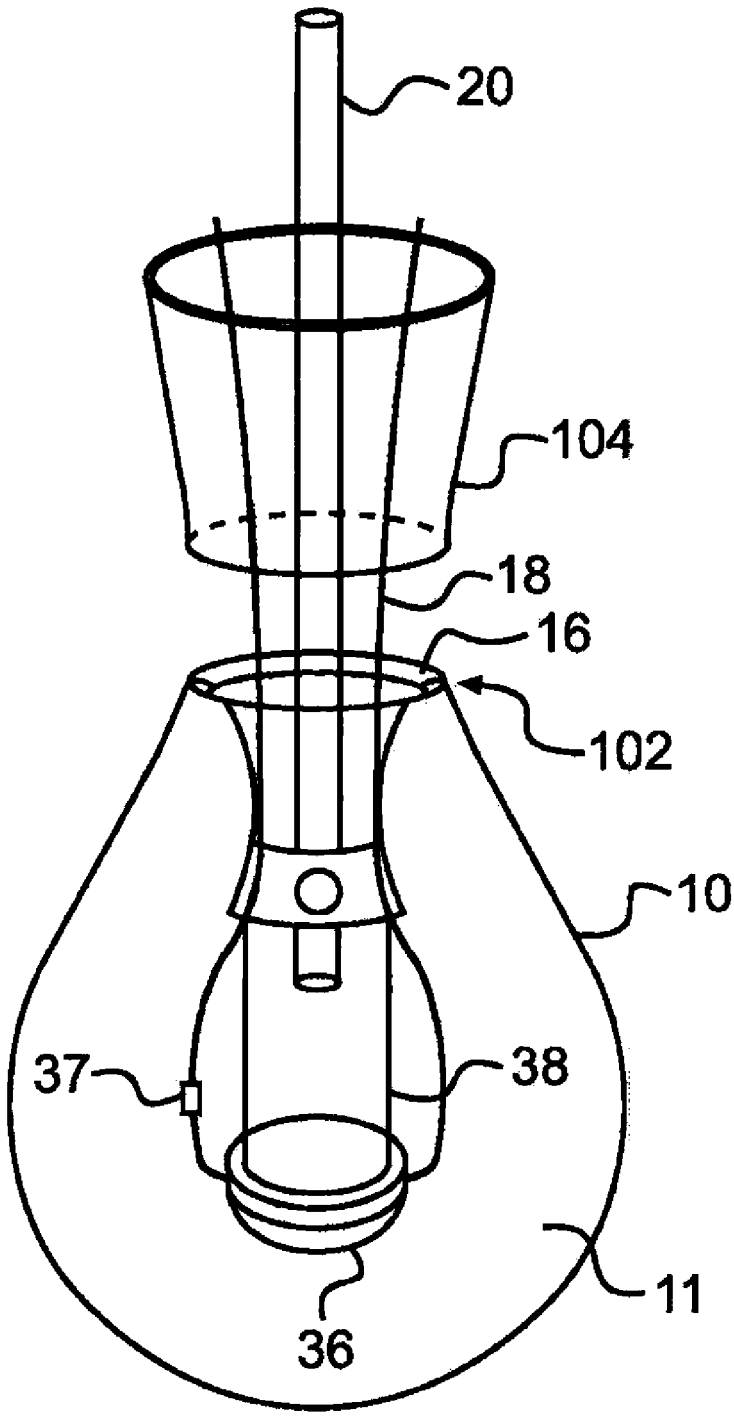
FIG. 6 illustrates a step of the production of an embodiment of an LED lamp consistent with the present invention.

FIG. 6 shows a step of the production of an embodiment of an LED lamp consistent with the present invention. The above heating process can fuse together the neck 102 of glass lampshell 10 and the glass trumpet tube 16 to form a cavity 11 that encloses the LED emitter 36. After the above heat-fusing process, the remaining glass lampshell waste 104 may be separated from the neck 102 of the glass lampshell 10 by pulling down the neck 102 of the glass lampshell 10 or pulling up the remaining glass lampshell waste 104. After these processes, because one end of the exhaust pipe 20 is within the cavity 11 and the other end of the exhaust pipe 20 is outside of the cavity 11, the air inside of the cavity 11 can communicate with exterior environment via the exhaust pipe 20.

The stem assembly 35 may contain an LED emitter 36 that is installed on a supporting component 38, which may be fixed together with an exhaust pipe 20 on a glass trumpet tube 16 and one end of the exhaust pipe 20 is connected to the cavity 11. The air in the cavity 11 may be evacuated through the exhaust pipe 20 and the exhaust pipe 20 is then sealed.

One end of the wire 18 may be electrically connected, preferably in series, with a temperature control component 37 and an LED lamp emitter 36, and the other end of the wire 18 is extended in an opposite direction and is used as a power supply wire.

There may be an exhaust pipe 20 on the said glass trumpet tube 16, and one end of the exhaust pipe 20 is connected to the cavity 11. The light-pervious liquid may be filled into the cavity 11 through the exhaust pipe 20 and the said exhaust pipe 20 is then sealed.

The glass lampshell 10 may have an acid-etching surface or sandblasting surface.

The glass lampshell 10 may have an acid-etching interior surface or a sandblasting interior surface.

A light-scattering material may be coated on the glass lampshell surface 10.

A light-scattering material may be coated on the interior surface of the glass lampshell 10.

A light-scattering glue may be contained in the cavity 11.

Using glass to pack a LED emitter may improve the production quality and efficiency of LED lamps, and reduce the production cost.

Figure 7:
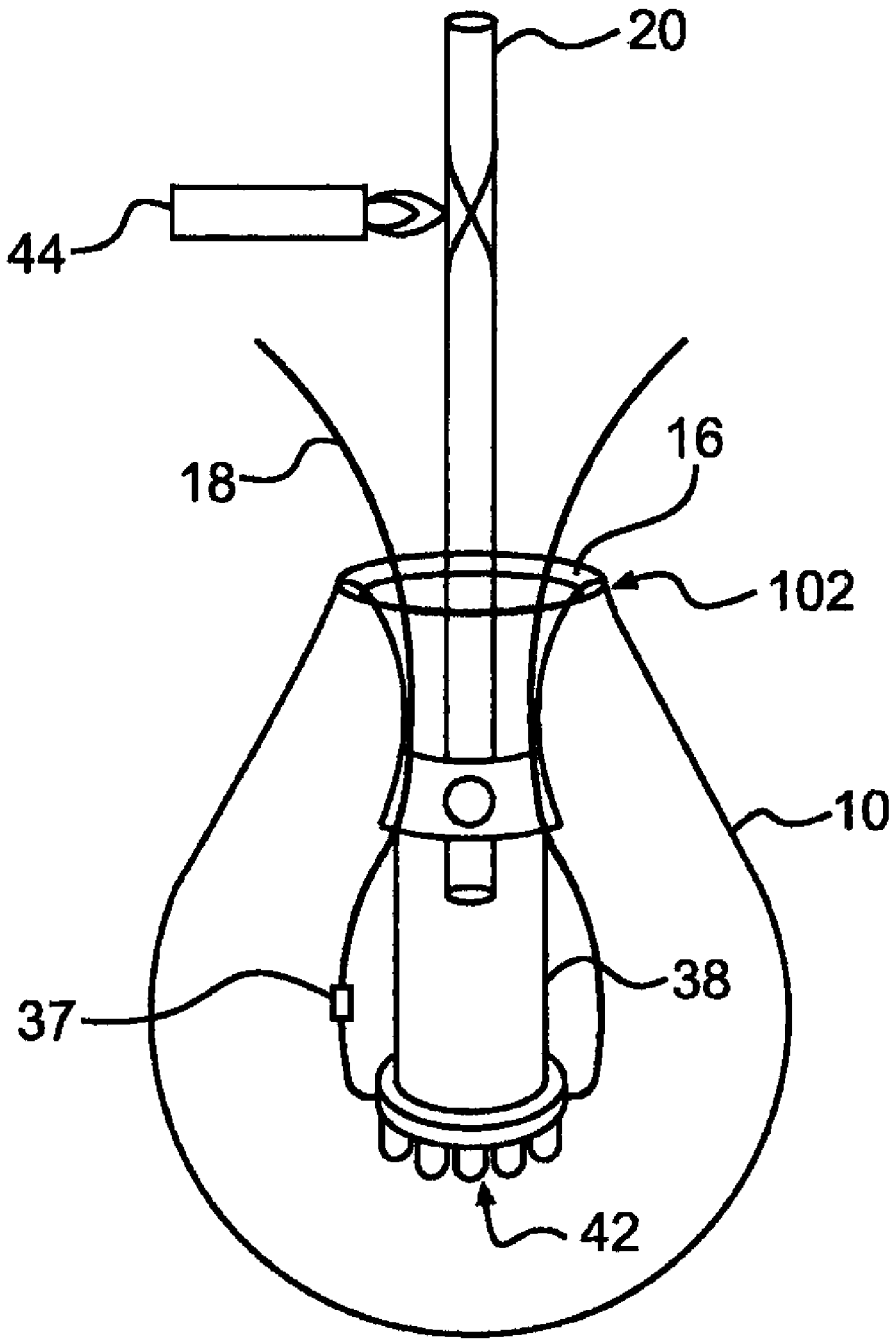
FIG. 7 illustrates an optional step of sealing exhaust pipe.

FIG. 7 illustrates an optional step of sealing exhaust pipe for exemplary embodiments of the present invention in which an exhaust pipe 20 is used. Since it is not necessary to isolate the LED emitter 36 from oxygen, in an embodiment where an exhaust pipe 20 is used, after the fusion by heating there is no need to seal the exhaust pipe 20. However, if it is desired to seal the exhaust pipe 20, flame heating nozzles 44 may be used to heat the exhaust pipe 20 to seal it. In another embodiment, before the exhaust pipe 20 is sealed, air in the cavity 11 may be evacuated first and then a light-pervious liquid may be filled in the cavity 11 via the exhaust pipe 20. A set of LED emitters 42 comprises multiple LEDs, which may include, for example, high power LEDs, low power LEDs, LEDs with different colors, or a combination thereof.

Figure 8:
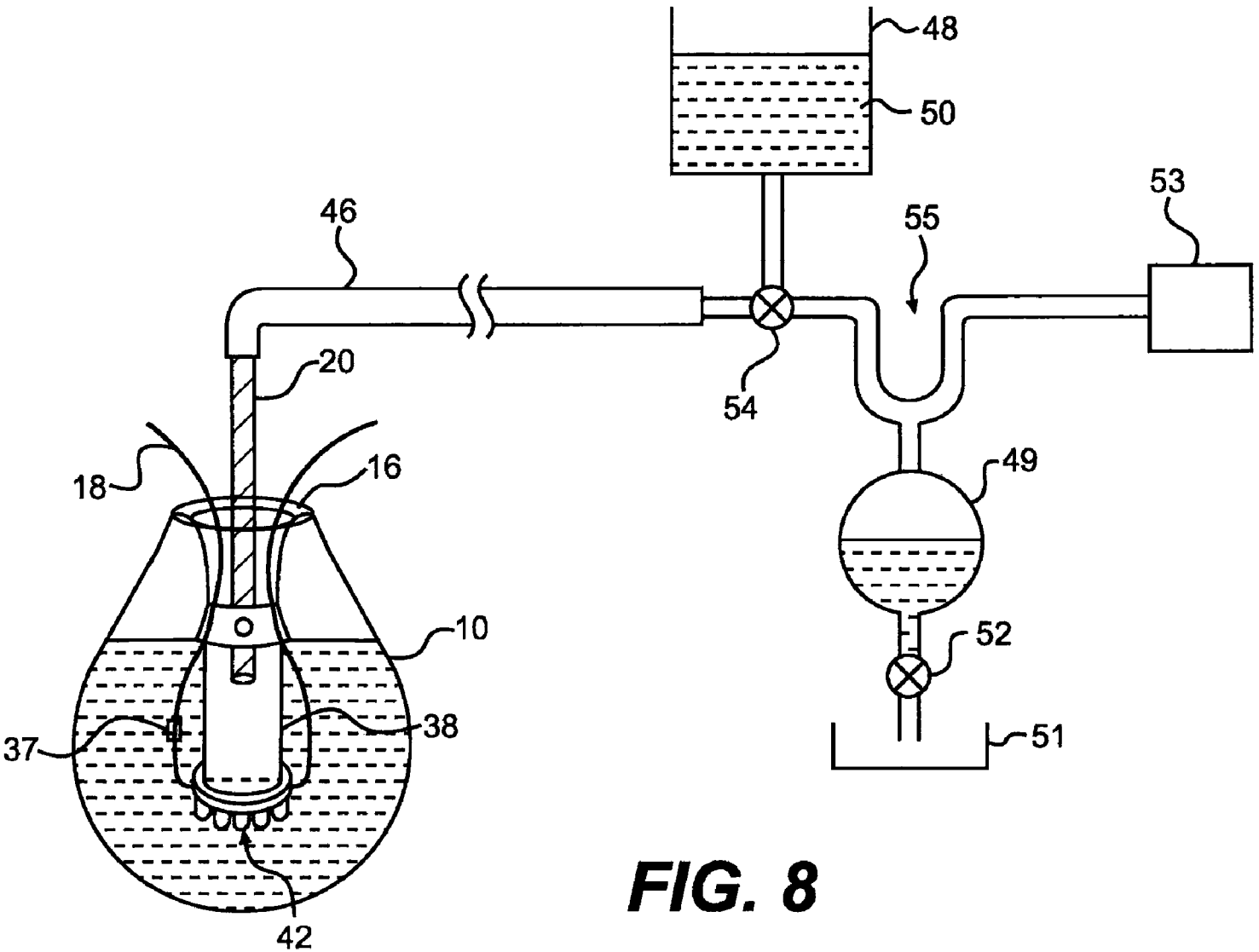
FIG. 8 illustrates a mechanism by which air and liquid can be removed from and filled in the cavity.

FIG. 8 illustrates a mechanism by which air and liquid can be removed from and filled in the cavity 11. The exhaust pipe 20 is connected to an air-exhausting and liquid-supplying conduit 46, and then via a direction valve 54, further connected to a liquid-supply tank 48, a flex tube 55, and a vacuum pump 53. The liquid-supply tank 48 contains a light-pervious liquid 50. For the first stage, the direction valve 54 is directed to open a route from air-exhausting and liquid-supplying conduit 46 to vacuum pump 53 via flex tube 55, and the vacuum pump 53 can evacuate the air inside the cavity 11 of the LED lamp to make a relatively high-vacuum, for example, from $1\times10^{-3}$ to $1\times10^{-9}$ torr or from 100 mPa to 100 nPa, within the cavity 11. Then by redirecting the direction valve 54, the light-pervious liquid 50 can be sucked into the cavity 11 via the air-exhausting and liquid-supplying conduit 46. Repeating the above steps 2 to 6 times, for example, the light-pervious liquid 50 within the cavity 11 can reach a desired level. The exhaust pipe 20 may then be heated and sealed. In another exemplary embodiment, it can be understood that the while the working environment of the production of the LED lamp of the present invention is carried out either partly or entirely in a vacuum environment, the exhaust pipe 20 may not be used.

The set of LED emitters 42 and temperature control component 37 may be immersed together in the light-pervious liquid 50. The temperature control component 37 can detect the temperature of the light-pervious liquid within the cavity 11, and when the temperature exceeds a certain default value, the temperature control component 37 may either turn off the electricity or increase the current resistance to cut off or reduce the current to the set of LED emitters 42 to avoid over-heating. It may also prevent the glass lampshell from explosive cracking that is caused by liquid expansion due to the high temperature of the light-pervious liquid 50 within the cavity 11. In another exemplary embodiment, the default range of the temperature control component 37 may be set to, for example, between 60° C. and 140° C. The temperature control component 37 could be realized by using, for example, a thermo-resister of positive temperature coefficient or a compound metallic temperature switch.

During the process where the air in the cavity 11 is evacuated by the vacuum pump 53 to reach a status of either medium or high vacuum, the light-pervious liquid 50 that exceeds a required level within the cavity 11 can be sucked back via the flex tube 55 and deposited in a storing tank 49. When the light-pervious liquid 50 in the storing tank 49 is full, a releasing valve 52 may be opened to let the light-pervious liquid 50 inside the storing tank 49 drain back in a liquid-recycle tank 51. The light-pervious liquid 50, which can be chosen from, for example, mineral substance-based isolation liquid, artificial compound isolation liquid, or any other low-stickiness light-pervious liquid or liquid with a low viscosity value, for example, less than 1.0 Pa at ambient temperature), may provide the LED lamp with better heat-dissipation effect and/or increase the output light flux. For example, the light-pervious liquid 50 can be chosen from liquids having, for example, a light refraction index of between 1.3 and 1.6 and a specific gravity of between 0.8 and 1.6, to enhance the output light flux and heat dissipation respectively. In addition, dyes may be added in the light-pervious liquid 50 for the purpose of modulating lamp colors or providing light scattering effect.

LED is a point light source. Its light-emitting angle is concentrated and therefore usually smaller than 120 degrees. To expand such angle, e.g. for illumination purposes, a light-scattering surface may be applied on the exterior of glass lampshell 10. The light-scattering effect may be made by acid-etching the exterior surface of glass lampshell 10 or sandblasting the exterior surface of glass lampshell 10 to make a ragged surface. In an exemplary embodiment, by immersing the glass lampshell 10 in hydrofluoric acid solvent for 5~30 seconds, a misted surface can be made. This step could be conducted before the heating process or after the sealing the LED lamp.

Figure 9:
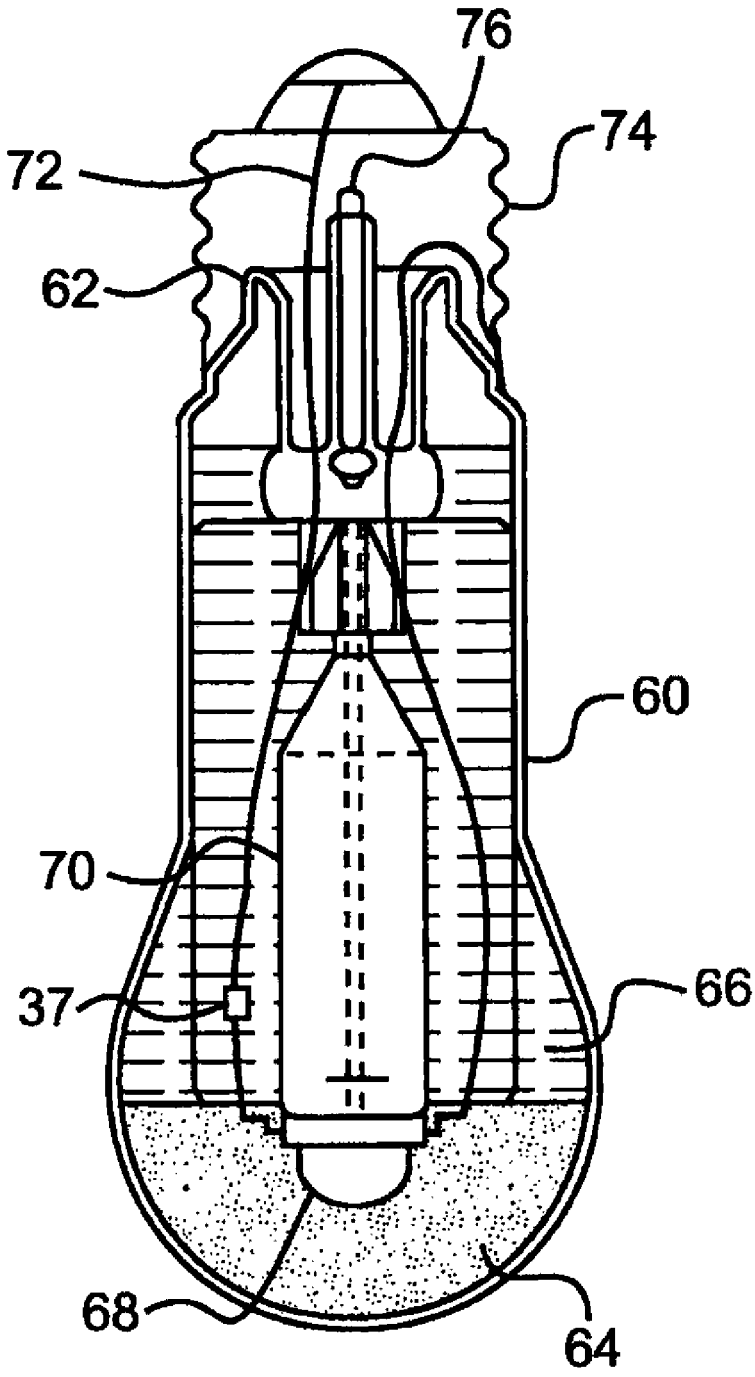
FIG. 9 illustrates an embodiment of an LED lamp consistent with the present invention.

FIG. 9 illustrates an embodiment of an LED lamp consistent with the present invention. Before the heating step shown in FIG. 4, a layer of light-scattering glue 64 may be introduced into the bottom of a glass lampshell 60. Then, the glass lampshell 60 may be heat-fused and connected to the glass trumpet tube 62, air inside the glass lampshell 60 is evacuated via an exhaust pipe 76, a light-pervious liquid 66 is filled in, and the exhaust pipe 76 is sealed.

The LED emitter 68 may be immersed in the light-scattering glue 64, as the light-scattering glue 64 provides good light-scattering effect. A supporting component 70 is made of thermal conductor like metal, and is immersed in an isolation liquid 66 to assist the LED emitters 68 to dissipate the heat to the light-pervious liquid 66. A wire 72 may be electrically connected in series with a LED emitter 68 and an optional temperature control component 37, and is further connected to a lamp base 74. The lamp base 74 is then fixed on glass lampshell 60.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An LED lamp comprising:

a glass lampshell;

a glass trumpet tube with a first end sealed within the glass lampshell to form a cavity within the glass lampshell;

an LED emitter within the cavity;

a supporting component within the cavity supporting and electrically insulated from the LED emitter and connected to the glass trumpet tube;

a wire encompassed within the glass trumpet tube having a first end extending outside of the cavity and a second end electrically connected to the LED emitter; and a temperature control component connected in series to the LED emitter via the wire.

2. The LED lamp of claim 1, wherein the cavity contains a liquid.

3. The LED lamp of claim 2, wherein the liquid is light-pervious.

4. The LED lamp of claim 2, wherein the liquid is selected from liquids with a light refraction index of between 1.3 and 1.6.

5. The LED lamp of claim 2, wherein the liquid is selected from liquids with a specific gravity of between 0.8 and 1.6.

6. The LED lamp of claim 2, wherein the liquid contains a dye.

7. The LED lamp of claim 2, wherein the temperature control component and the LED emitter are immersed in the liquid.

8. The LED Lamp of claim 1, where the stem assembly further comprises an exhaust pipe encompassed within the glass trumpet tube having a first end extending outside of the cavity and a second end within the cavity such that air in the cavity may be evacuated via the exhaust pipe.

9. The LED lamp of claim 1, wherein the temperature control component is selected from a group consisting of thermo-resister of positive temperature coefficient, compound metal temperature switch, and a combination thereof.

10. The LED lamp of claim 1, wherein the temperature control component has a default temperature between 60° C. and 140° C.

11. The LED lamp of claim 1, wherein the glass lampshell has an acid-etching exterior surface.

12. The LED lamp of claim 1, wherein the glass lampshell has a sandblasting exterior surface.

13. The LED lamp of claim 1, wherein the glass lampshell has an exterior surface with light-scattering coating.

14. The LED lamp of claim 1, wherein the LED emitter contains at least one LED chip.

15. The LED lamp of claim 1, wherein the supporting component is thermal conductive.

16. The LED lamp of claim 1, further comprising a light-scattering material and a liquid separated from the light-scattering material.

17. The LED lamp of claim 16, wherein the LED emitter is immersed in the light-scattering material and the temperature control component is immersed in the liquid.

18. The LED lamp of claim 1, wherein the cavity contains a medium vacuum.

19. The LED lamp of claim 1, wherein the cavity contains a high vacuum.

20. The LED lamp of claim 16, wherein the wire has a first portion immersed in the light-scattering glue and a second portion immersed in the liquid, a length of the second portion is greater then a length of the first portion.

* * * * *